US006122463A

United States Patent [19]

Nagatani

[11] Patent Number: 6,122,463

[45] Date of Patent: Sep. 19, 2000

[54] IMAGE FORMING APPARATUS WITH REGISTRATION CODE CONTROL DEVICE

[75] Inventor: Kentaro Nagatani, Toyohashi, Japan

[73] Assignee: Minolta Co., Ltd., Osaka, Japan

[21] Appl. No.: 09/079,141

[22] Filed: May 15, 1998

[30] Foreign Application Priority Data

May 16, 1997 [JP] Japan ..... 9-141134

[51] Int. Cl.[7] ..... G03G 15/00

[52] U.S. Cl. ..... 399/80; 399/85

[58] Field of Search ..... 399/79, 80, 81, 399/85; 713/202; 705/18; 711/164

[56] References Cited

U.S. PATENT DOCUMENTS

| | | | |
|---|---|---|---|
| 4,497,037 | 1/1985 | Kato et al. | 399/80 |
| 5,014,088 | 5/1991 | Wakikaido et al. | 399/80 |
| 5,077,582 | 12/1991 | Kravette et al. | 399/8 |
| 5,142,324 | 8/1992 | Ito . | |
| 5,293,197 | 3/1994 | Iwao . | |
| 5,832,339 | 11/1998 | Inui et al. | 399/83 |

FOREIGN PATENT DOCUMENTS

| | | |
|---|---|---|
| 04073776 | 3/1992 | Japan . |
| 04097370 | 3/1992 | Japan . |

*Primary Examiner*—Robert Beatty
*Attorney, Agent, or Firm*—McDermott, Will & Emery

[57] ABSTRACT

A copying machine that allows copying by inputting an access code at the time of use without registering said access code in advance and that can also register said access code. In the control routine by CPU 601 that controls the copying machine, when a control-by-section mode selection signal is input using key 45 on the operation panel, selection of automatic code input mode (the second mode), which is different from regular mode (the first mode), is permitted. When automatic code input mode is selected and an access code is input using 10-key keypad 42 on the operation panel, the input access code is registered and control is performed so that the copying operation is permitted. By limiting the period of validity for the access codes registered, the memory capacity in the access code registration memory may be effectively utilized and only sections that actually use the copying machine can be registered.

17 Claims, 12 Drawing Sheets

FIG.3(a) [display 1]

Input access code

XXXX input print-key
re-input clear key

FIG.3(b) [display 2]

Control by section

YES NO select clear key
OK print-key

FIG.3(c) [display 3]

NORMAL AUTO
SUPERVISOR COUNTER
DELETE INELGIBLE select clear key
OK print-key

FIG.3(d) [display 4]

Input access code

XXXX input print-key
re-input clear key

FIG.3(e) [display 5]

Access code already registered
Input different access code
XXXX input print-key
re-input clear key FIG.3(f) [display 6]

Access code ineligible
Input different access code
XXXX input print-key
re-input clear key FIG.3(g) [display 7]

Access code XXXX
counter 1 counter 3
counter 2 counter 4

OK print-key
clear clear key

FIG.3(h) [display 0]

BLANK

IMAGE FORMING APPARATUS WITH REGISTRATION CODE CONTROL DEVICE

This application is based on application No. 9-141134 filed in Japan, the contents of which is hereby incorporated by reference.

BACKGROUND OF THE INVENTION

1. Field of the Invention

The present invention pertains to a control device, specifically to a control device for an image forming apparatus, and especially to an image forming apparatus that can control its use by means of access codes.

2. Description of the Related Art

In order to prevent unlimited use of an image forming apparatus when there are large numbers of people that use the apparatus, an access code system has been proposed. Under this access code system, persons and sections that are permitted to use the image forming apparatus are assigned an access code, and these access codes are registered in the image forming apparatus in advance. When the user seeking to use the image forming apparatus enters the access code before using the apparatus, the apparatus compares the entered access code with the access codes registered beforehand, and if the number matches any of the registered codes, control is performed so that the copying operation is permitted.

Where said access code system is used with an image forming apparatus, the operation to register the access codes in the image forming apparatus is often performed by a service technician or by the person in charge of supervising the use of the image forming apparatus. As a result, because access codes assigned to persons and sections that do not actually use the image forming apparatus are also registered, the storage capacity of the internal memory used to store the access codes in the image forming apparatus becomes inadequate, creating the problem that access codes that need to be registered cannot be registered. Moreover, the problem also occurs that because an access code has not been registered, the image forming apparatus cannot be used in an urgent situation where it must be used immediately.

The object of the present invention is to provide a control device that can eliminate the inconvenience of registering codes in the image forming apparatus beforehand and allow the immediate registration of new codes.

SUMMARY OF THE INVENTION

The present invention is an image forming apparatus that solves the problem described above, and is equipped with an input unit to input codes, a code memory unit that stores the codes, a code verification unit that verifies whether a code input by means of the input unit matches any of the codes stored in the code memory unit, and a control unit that (i) when a first mode is designated, permits operation when it is determined from the result of the verification performed by the code verification unit that an input code is a registered code for which operation is permitted, and (ii) when a second mode is designated, stores the input code in the code memory unit as a registered code.

Where the second mode is designated, operation is permitted after the input code is stored in the code memory unit as a registered code.

Furthermore, where the second mode is designated, the control unit switches to the first mode after a prescribed period of time has elapsed.

Codes for which operation is permitted and codes for which operation is not permitted are differentiated and stored in the code memory unit. Where the input code is a code for which operation is not permitted, the control unit refuses to store the input code in the code memory unit as a registered code.

The present invention is also a control method for an image forming apparatus that solves the problems described above, and comprises the following steps: an input step to input a code, a code verification step to verify whether the input code matches any of the codes stored in the code memory unit, and a control step that (i) when a first mode is designated, permits operation when it is determined from the result of the verification performed by the code verification step that the input code is a registered code for which operation is permitted, and (ii) when a second mode is designated, stores the input code in the code memory unit as a registered code.

The image forming apparatus that employs the present invention is equipped with an input means that inputs access codes, an access code memory means that stores access codes as registered access codes, an access code verification means that verifies whether an access code input by means of the input means matches any of the registered access codes stored in the access code memory means, a mode designation means that designates either a first mode or a second mode that permit operation of the image forming apparatus, and a control means, wherein (i) when a first mode is designated via said mode designation means, said control means sets the first mode in which operation of the image forming apparatus is permitted when it is determined from the result of the verification performed by the access code verification means that the input access code is a registered access code for which operation of the image forming apparatus is permitted, and (ii) when a second mode is designated, said control means stores the input access code in the access code memory means as a registered access code, and then sets the second mode in which the operation of the image forming apparatus is permitted.

The image forming apparatus is also equipped with one or more of the following means: a remaining memory detecting means that detects the remaining memory capacity in the access code memory means, a copy number detecting means that detects the number of copies made, and an elapsed time detecting means that detects the amount of time elapsed since the setting of the second mode. The control means clears the second mode and sets the first mode in any of the following three situations: where the detected remaining memory capacity falls below a certain level, where the detected number of copies is higher than a prescribed level, or where the detected elapsed time is longer than a prescribed interval.

The access code memory means differentiates between access codes for which operation of the image forming apparatus is permitted and access codes for which operation of the image forming apparatus is not permitted, and stores both types of access codes.

Where it is determined from the result of the verification performed by the access code verification means that the input access code is an access code for which operation of the image forming apparatus cannot be permitted, the control means performs control such that the input access code is not registered in the access code memory means.

These and other objects, advantages and features of the invention will become apparent from the following description thereof taken in conjunction with the accompanying drawings which illustrate specific embodiment of the invention.

BRIEF DESCRIPTION OF THE DRAWINGS

In the following description, like parts are designated by like reference numbers throughout the several drawings.

FIG. 3 is a drawing explaining the display of the LCD unit.

DESCRIPTION OF THE PREFERRED EMBODIMENT

Figure 1:
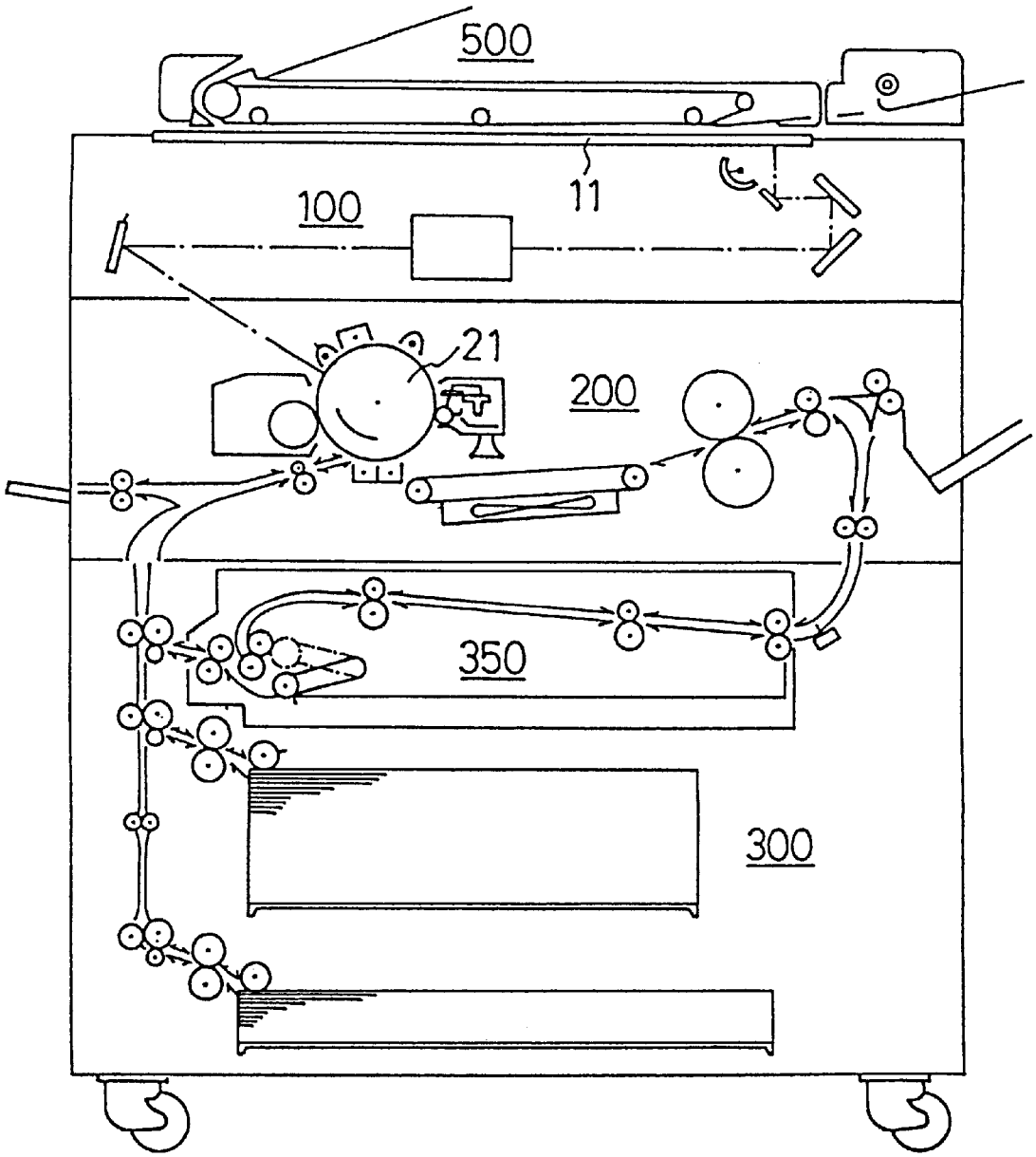
FIG. 1 is a cross-sectional view showing the construction of a copying machine in which the present invention may appropriately be applied.

An embodiment of the present invention will be explained below with reference to the drawings. Among image forming apparatuses appropriate for the application of the present invention, FIG. 1 shows a cross-sectional view of the construction of a representative copying machine. The copying machine shown in FIG. 1 is a public domain copying machine, and includes optical system 100 in its upper section, image forming unit 200 including photoreceptor 21 in its middle section, and paper supply unit 300 and paper re-supply unit 350 in its lower section. In addition, automatic original document feeder 500, which is also in the public domain, is located above platen glass 11.

The image forming mechanism and operation by which an original document is sent to a prescribed position on platen glass 11 by means of automatic original document feeder 500, an original document image is projected onto photoreceptor 21 by means of optical system 100 to form a latent image, the latent image is developed using toner, the developed toner image on the photoreceptor is transferred onto a sheet of recording paper supplied from paper supply unit 300 or paper re-supply unit 350, the toner image is then fused onto the paper, and the paper is ejected, are in the public domain, and therefore, their detailed explanation will be omitted here.

Figure 2:
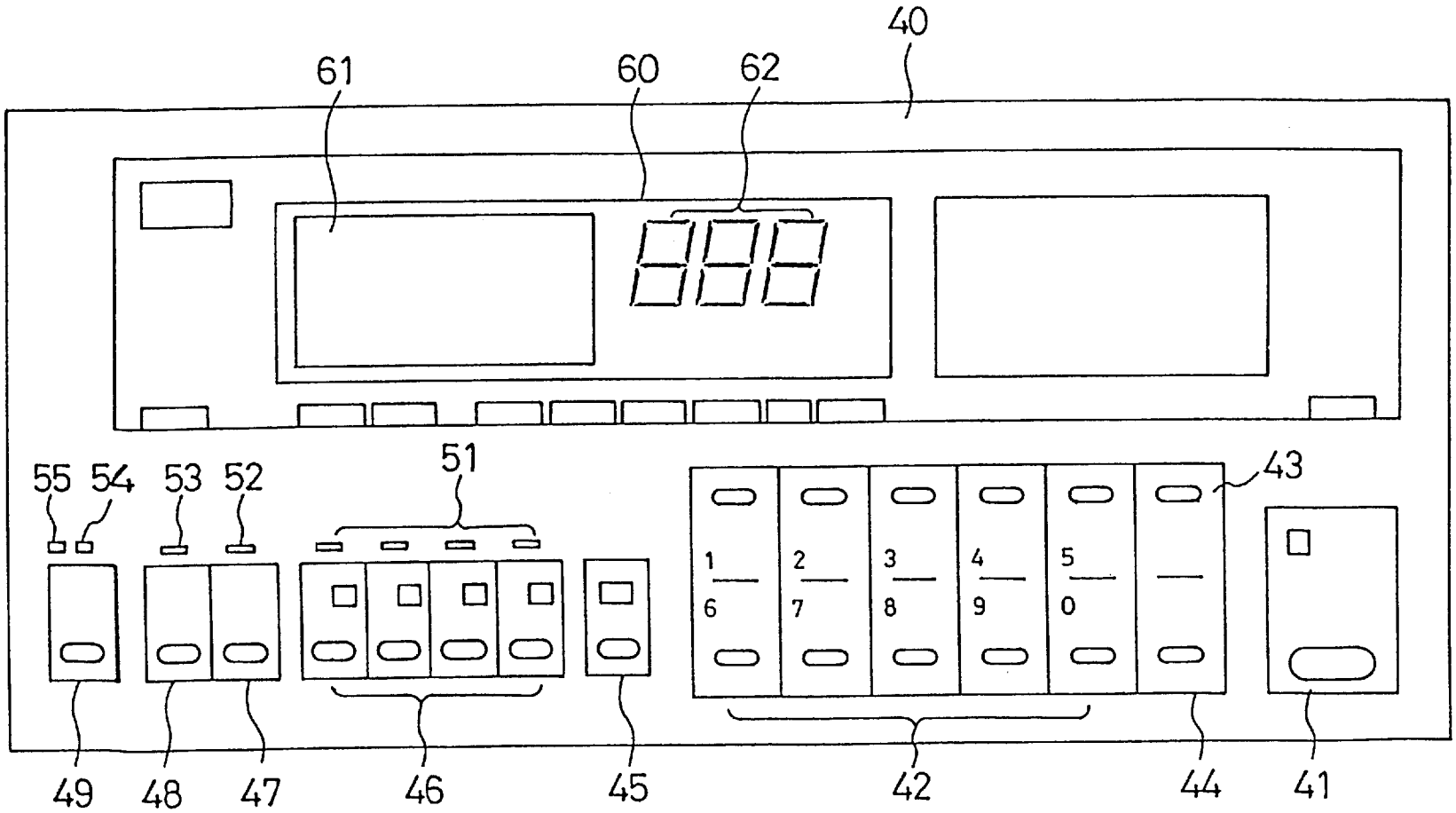
FIG. 2 is a front elevation showing the construction of the operation panel of the copying machine.

FIG. 2 is a front elevation showing the construction of operation panel 40 of the copying machine. Print key 41 located on operation panel 40 is a key to instruct the commencement of the print operation. In the present invention, in addition to the instruction to commence the print operation, where control-by-section mode selection key 45 described below has been pressed, print key 41 is also used for confirmation of the access code input in control-by-section mode. This will be explained in detail below.

10-key keypad 42 is used for inputting access codes, the number of copies, etc. Control-by-section mode selection key 45 is used for selecting control-by-section mode, and magnification key 46 is used for inputting the magnification.

2-in-1 mode key 47 is used to select 2-in-1 mode in which a two-page original document is copied to a single page of recording paper, two-sided copy mode key 48 is used to select two-sided copy mode, and binding margin key 49 is used to set the mode to set a binding margin during copying.

Clear key 43 is used to return the number of copies input by means of the 10-key keypad to the initial value (normally 1). In the present invention, where control-by-section mode selection key 45 has been pressed, clear key 43 is also used for re-inputting an access code, selecting and clearing control-by-section mode, etc. This will be explained in detail below.

Panel reset key 44 is used for resetting various displays on the operation panel, i.e., for example, the input number of copies or the copy magnification. In the present invention, in addition to resetting the panel display, where control-by-section mode selection key 45 has been pressed, panel reset key 44 is also used to return the current display of the LCD unit to its initial display.

LEDs 51 through 55 that display the operation status of the various keys described above are located close to the keys pertaining to them on the operation panel.

Display unit 60 is located on the operation panel and comprises LCD unit 61 that displays the status of the copy magnification, etc., set in the copying machine, as well as messages to be transmitted to users, etc., and numerical value display unit 62 that displays numerical values input by means of the 10-key keypad, such as the number of copies.

Control of the persons and sections that use the copying machine by means of access codes, as well as control of the number of copies by means of copy counters that work together with their corresponding access codes, will now be explained.

Access codes for controlling the copying machine based on sections that use it are registered through procedures termed 'normal registration' and 'automatic code input'. 'Normal registration' and the copy mode termed 'first mode' set during normal registration, as well as 'automatic code input' and the copy mode termed 'second mode' set during automatic code input, will be explained below.

Access code registration is performed by means of an interactive operation in which the user registers the access code while viewing the display on LCD unit 61. The various displays shown on LCD unit 61 during access code registration are shown in (a) through (h) of FIG. 3.

When the power is turned ON, or when LCD unit 61 on the operation panel has been reset by means of panel reset key 44, the display on LCD unit 61 is a blank display, as shown in (h) of FIG. 3, and this is the display status present when regular copying is performed without control based on the user section. This status will be termed 'display 0'. In this state, regular copying can be performed.

If control-by-section mode selection key 45 is pressed in this state, the display screen shown in (a) of FIG. 3 as 'display 1' is shown on LCD unit 61. An access code is input by means of 10-key keypad 42, and if there is no input error, print key 41 is pressed to finalize and input the access code. If there is an input error, clear key 43 is pressed and the access code is re-input.

When the access code is input and the print key is pressed, the display screen is switched to the display termed 'display 2' shown in (b) of FIG. 3. When clear key 43 is pressed, 'Yes' and 'No' to perform control by section appear as alternate selections and the selected response is displayed in a special manner (white-on-black display, for example). When the desired response is displayed in a special manner, print key 41 is pressed to finalize either 'Yes' or 'No'. When 'No' regarding control by section is selected and confirmed, copying may be performed freely, but when 'Yes' regarding control by section is selected and confirmed, copying cannot be performed unless a prescribed access code is input.

Where 'Yes' regarding control by section is selected and confirmed, the display screen switches to the display termed 'display 3' shown in (c) of FIG. 3. Using this screen, access code registration, access code deletion, registration of codes that should not be registered as access codes (ineligible code registration) and a request for display of section counters may be performed. In addition, 'normal registration' and 'automatic code input' may be alternately selected.

If clear key 43 is pressed when 'display 3' shown in (c) of FIG. 3 is present, 'normal registration', 'automatic code input', 'supervisor registration', 'see counter', 'delete' and 'ineligible code registration' are sequentially selected and displayed in a special manner (white-on-black display, for example). When the desired item is displayed in said special manner, the item may be confirmed by pressing print key 41.

If 'normal registration' is selected and confirmed, the display screen changes to the display termed 'display 4' shown in (d) of FIG. 3. If the supervisor of the copying machine inputs an access code assigned in advance to each section when this screen is present, the access code is stored in the access code registration memory and thus becomes registered, whereupon the first mode is set. The same key operations as explained with reference to 'display 1' of (a) of FIG. 3 are used for the input, confirmation and re-input of an access code.

When registration of an access code is completed, the display screen changes to 'display 1' shown in (a) of FIG. 3. When copying is performed thereafter, the user needs to input the same access code as the one that has been registered.

If 'automatic code input' is selected and confirmed, the display screen switches to 'display 4' shown in (d) of FIG. 3. If an access code that the user wants to use is input when this screen is present, the access code is stored in the access code registration memory and thus becomes registered, whereupon the second mode is set.

While this 'automatic code input' is selected, the user may freely make copies by inputting an access code that he wants to use. The access code input is stored in the access code registration memory and becomes registered, and the value in the copy counter that counts the number of copies is also saved in the copy counter memory.

When 'automatic code input' is canceled, the copying machine enters the 'normal registration' status of the first mode, and thereafter, the user must input the same access code as the one he previously input and registered when making copies.

When an access code is input while 'automatic code input' is present and if the access code matches an access code that has already been registered, the display screen changes to the display termed 'display 5' shown in (e) of FIG. 3, indicating that the access code for which the registration operation was performed cannot be registered and requesting registration of a different access code. The same key operations explained with reference to 'display 1' of (a) of FIG. 3 are used for the input, confirmation and re-input of an access code.

'Supervisor registration' is a procedure to register the supervisor who is responsible for the control of access codes. Where 'supervisor registration' is selected and confirmed, the display screen changes to 'display 4' shown in (d) of FIG. 3. The access code for the supervisor responsible for the control of access codes is then input. Through this operation, the access code for the supervisor is stored in the access code registration memory and becomes registered. The same key operations explained with reference to 'display 1' of (a) of FIG. 3 are used for the input, confirmation and re-input of an access code.

'See counter' is selected when the user wants to see the value in the copy counter in order to learn how many copies have been made for each section. Where 'See counter' is selected and confirmed, the display screen switches to 'display 4' shown in (d) of FIG. 3. When the access code for the section whose record the user wants to see is input, the display screen changes to the display termed 'display 7' shown in (g) of FIG. 3. In this example, the values in four counters 1 through 4 are displayed (this is because four access codes are registered for individuals in the section designated by the input access code and the values in their counters 1 through 4 are being displayed).

In order to clear the value in the copy counter, the counter that the user wants to clear is selected and confirmed using the print key, and when the selected counter is displayed in a special manner (white-on-black display, for example), the value in the selected counter may be cleared by pressing the clear key.

'Delete' is a procedure to delete an access code that has already been registered, an access code input and registered via 'automatic code input', or an access code registered via 'ineligible code registration'. Where 'delete' is selected and confirmed, the display screen changes to 'display 4' shown in (d) of FIG. 3. An access code is deleted by inputting the code that the user wants to delete.

'Ineligible code registration' is a procedure to register codes that may be input via 'automatic code input' and for which registration is not desired. The purpose of this procedure is to prevent the registration of clearly incorrect codes, so that a code for a section that does not exist may not be registered, for example. In addition, since registration of new access codes may be required in the future, 'ineligible code registration' is used in order to set such access codes aside. Where 'ineligible code registration' is selected and confirmed, the display screen changes to 'display 4' shown in (d) of FIG. 3, wherein an access code (ineligible code) that the user wants to register is input.

When a new access code is registered using the 'normal registration' procedure after code registration via 'ineligible code registration', and if the new access code is a registered ineligible code, the display screen changes to the display termed 'display 6' shown in (f) of FIG. 3, indicating that the access code for which the registration operation was performed cannot be registered and requesting registration of a different access code.

Figure 4:
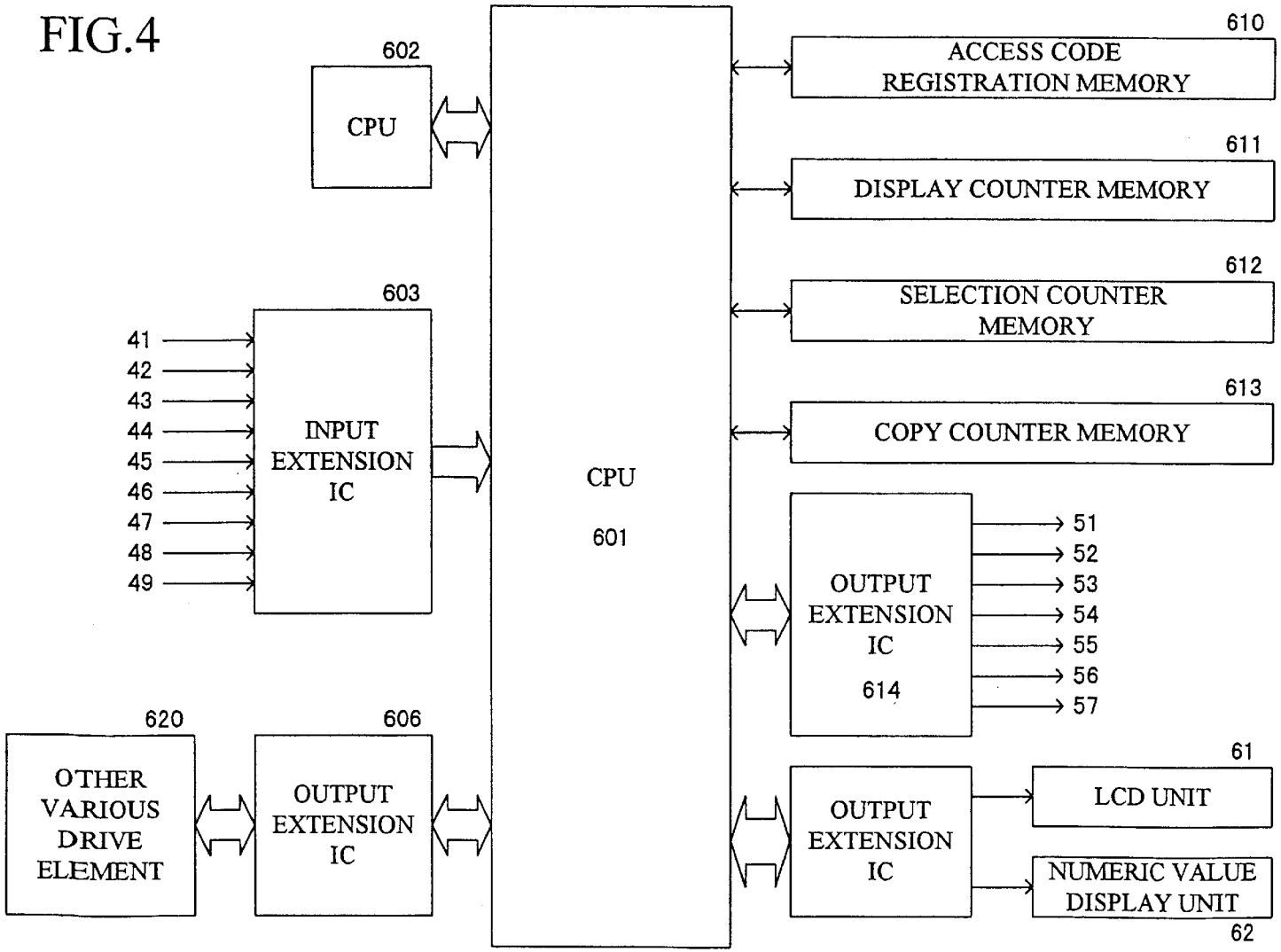
FIG. 4 is a block diagram showing the basic construction of the control circuit for the copying machine.

FIG. 4 is a block diagram showing the basic construction of the control circuit for the copying machine. The control circuit comprises CPU 601 that controls the copying machine and CPU 602 that controls the automatic original document feeder, and CPU 601 and CPU 602 are linked such that they can exchange signals. To the input port of CPU 601 that controls the copying machine are connected via input extension IC 603 the key switches on operation panel 40, i.e., print key 41, 10-key keypad 42, clear key 43, panel reset key 44, control-by-section mode selection key 45, magnification key 46, 2-in-1 key 47, two-sided copy mode key 48 and binding margin key 49, as well as other switches and sensors.

To the output port of CPU 601 are connected LEDs 51 through 55 that display the operation status of the various key switches described above via output extension IC 604, LCD unit 61 and numeric value display unit 62 via output extension IC 605, and the main motor of the copying machine and other various drive elements 620 via output extension IC 606. In addition, access code registration memory 610, display counter memory 611, selection counter memory 612, and copy counter memory 613 that stores the number of copies by section as well as the total number of copies, are connected to CPU 601. For these memories, non-volatile memories whose memory contents are not erased when power is turned OFF or memories backed up by a battery are used.

Figure 5:
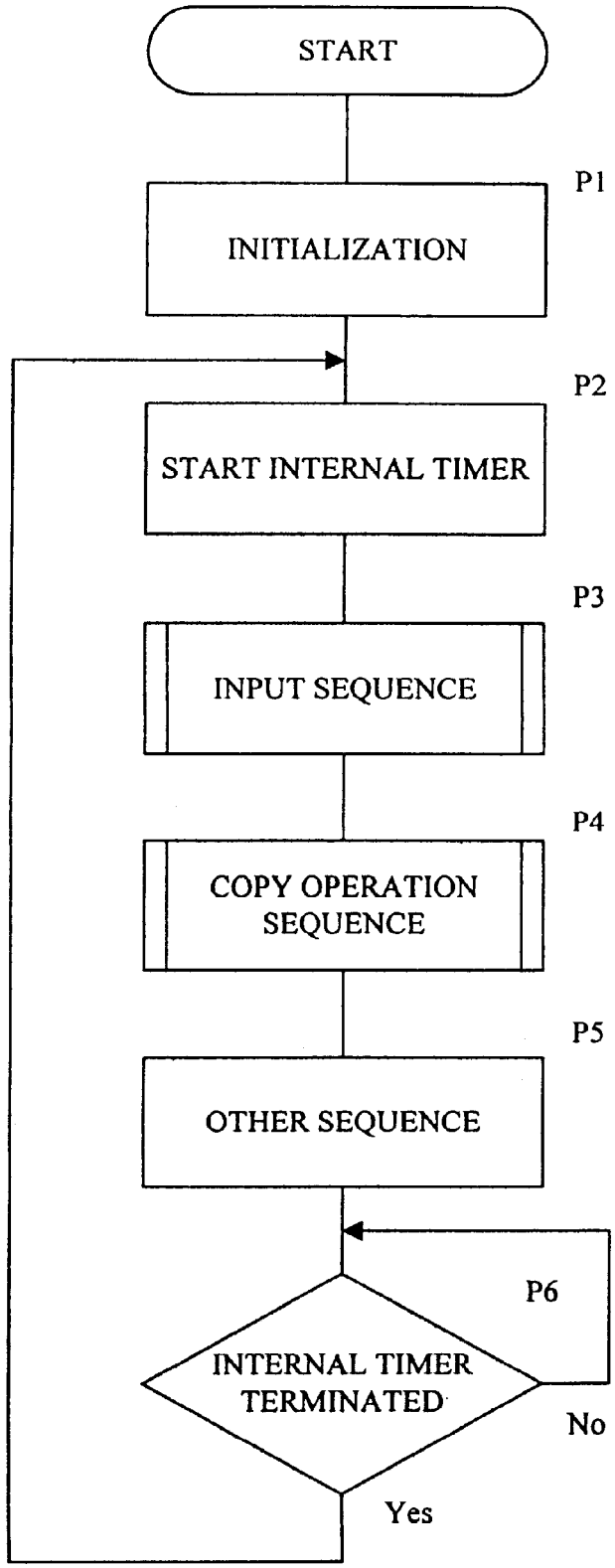
FIG. 5 is a flow chart outlining the control sequence performed by the control circuit.

FIG. 5 is a flow chart of the main routine showing the basic control sequence for the copying machine that is executed by copying machine CPU 601. The sequence starts when power is turned ON and the initialization procedure that includes clearing of the various memories is performed (step P1). Counting by an internal timer that regulates the duration for one routine is then begun (step P2).

Input routines using the various keys on the operation panel, the copy operation sequence, and other control sequences then take place (steps P3, P4 and P5). When counting by the internal timer is completed (step P6), CPU 601 returns to step P2 and repeats the routines of steps P2 through P6.

Figure 6:
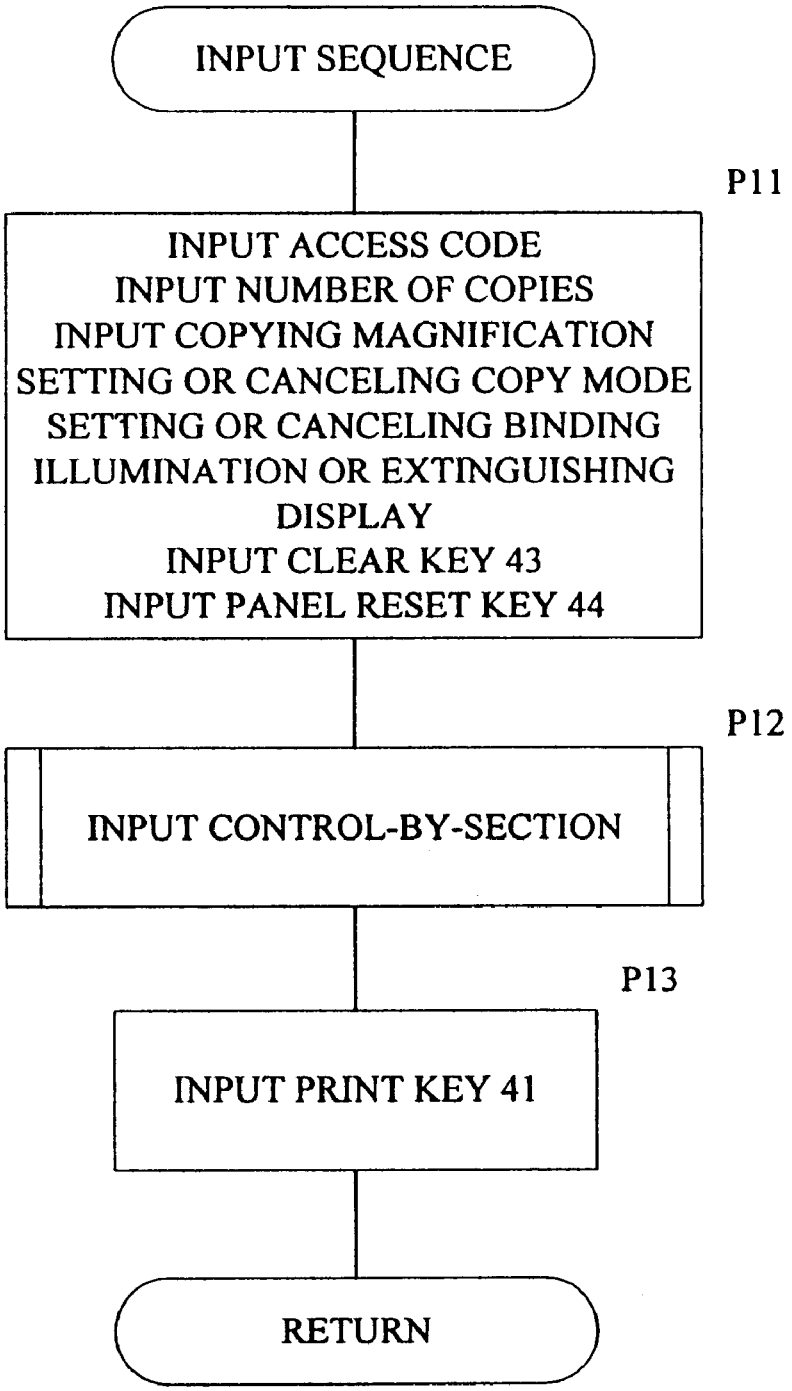
FIG. 6 is a flow chart showing in detail the input sequence for the various keys on the operation panel.

FIG. 6 is a flow chart showing the details of the input sequence using the various keys on the operation panel, which sequence was shown as step P3 in the flow chart of FIG. 5. First, signal processing pertaining to (i) input of an access code and for a number of copies, corresponding to the operations of 10-key keypad 42, (ii) input of copying magnification using magnification key 46, (iii) setting or canceling of copy mode input using 2-in-1 mode key 47 or two-sided copy mode key 48, (iv) setting or canceling of a binding margin input using binding margin key 49, (v) illumination or extinguishing of display LEDs 51 through 55 on the operation panel, corresponding to the operation of the input keys described above), and (vi) input using clear key 43 or panel reset key 44 is performed (step P11). Processing of the input from control-by-section mode selection key 45 (step P12) and processing of the input from print key 41 (step P13) are then performed, whereupon CPU 601 returns to the main routine.

Figure 7:
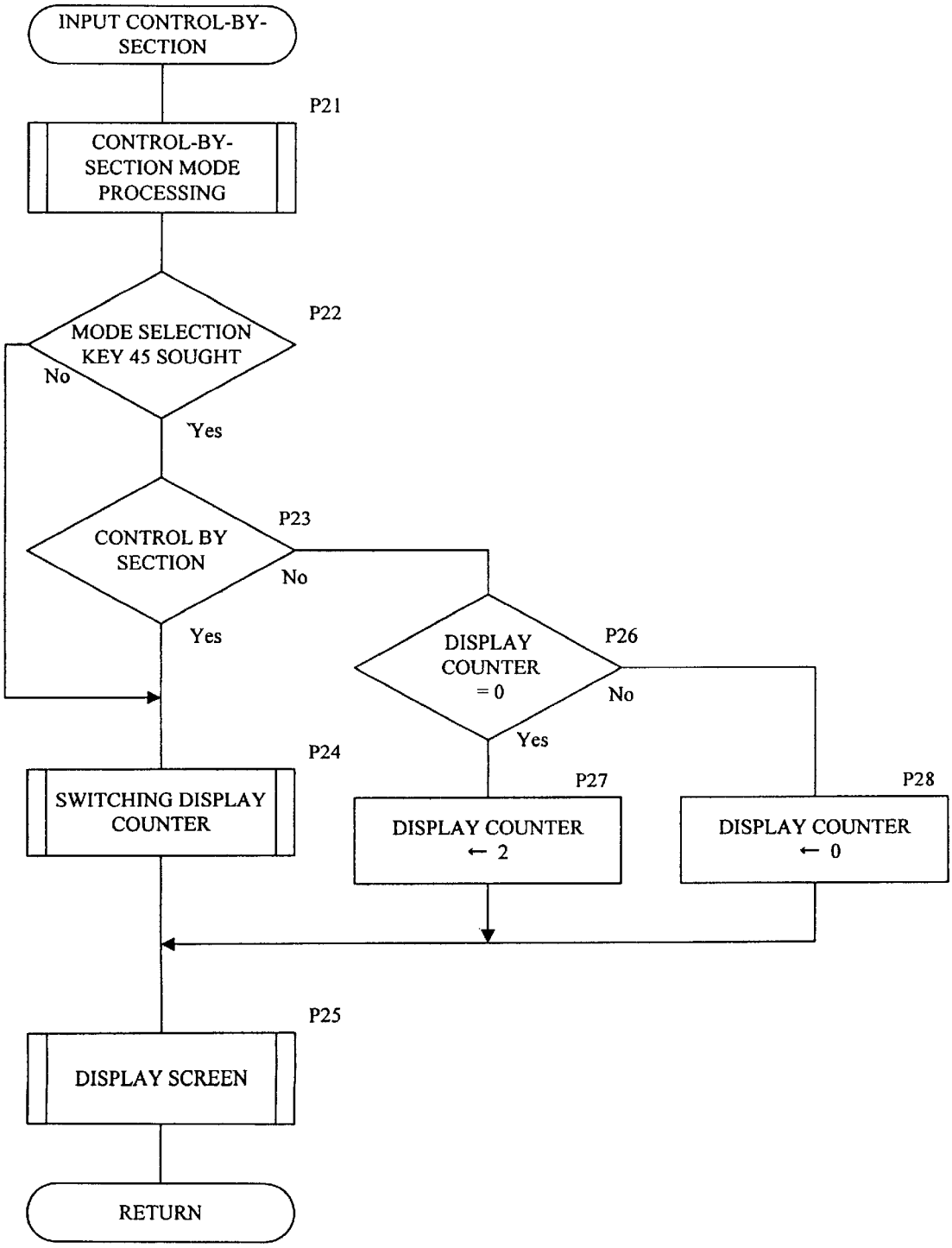
FIG. 7 is a flow chart showing in detail the input sequence for the control-by-section mode selection key.

FIG. 7 is a flow chart showing the details of the input routine regarding control-by-section mode selection key 45 that was shown as step P12 in the flow chart of FIG. 6.

The display counter will now be explained. The display counter is a counter that controls the display on LCD unit 61 on the operation panel. The value in the display counter and the display screen of LCD unit 61 have the relationship shown in Table 1 below.

Table 1

Display counter value is 1→ Display screen—'display 1' of (a) of FIG. 3

Display counter value is 2→ Display screen—'display 2' of (b) of FIG. 3

Display counter value is 3→ Display screen—'display 3' of (c) of FIG. 3

Display counter value is 4→ Display screen—'display 4' of (d) of FIG. 3

Display counter value is 5→ Display screen—'display 5' of (e) of FIG. 3

Display counter value is 6→ Display screen—'display 6' of (f) of FIG. 3

Display counter value is 7→ Display screen—'display 7' of (g) of FIG. 3

Display counter value is 0→ Display screen—'display 0' of (h) of FIG. 3

First, the control sequence regarding control-by-section mode is executed (step P21). The details of this sequence are explained with reference to the flow chart of FIG. 8. In this routine, automatic switching from 'automatic code input' to 'normal registration' is performed based on the time, remaining memory capacity and count value in the copy counter.

A rising edge regarding control-by-section mode selection key 45 is then sought (step P22). If it is detected, it is determined whether or not 'Yes' regarding control by section has been selected based on the flag that is set when 'Yes' regarding control by section is selected (see 'display 2' of (b) of FIG. 3) (step P23). Where 'Yes' regarding control by section is selected, routines for switching of the display counter (step P24) and the display screen (step P25) are performed, whereupon CPU 601 returns to the main routine.

Where it is determined in step P23 that 'No' regarding control by section is selected and confirmed, it is determined whether or not the display counter value is 0 (step P26). Where it is 0, the display counter is set to 2 (step P27), and CPU 601 returns to step P25. Where the display counter value is not 0, it is set to 0 (step P28), and CPU 601 returns to step P25. In other words, each time control-by-section mode selection key 45 is pressed, a regular display screen ('display 0' of (h) of FIG. 3) and a screen that requests the selection or non-selection of control by section ('display 2' of (b) of FIG. 3) are alternately displayed.

If a rising edge regarding control-by-section mode selection key 45 is not detected in step P22, CPU 601 immediately moves to the routines of and after step P24 to perform switching of the display counter (step P24) and screen display (step P25) and returns to the main routine.

Figure 8:
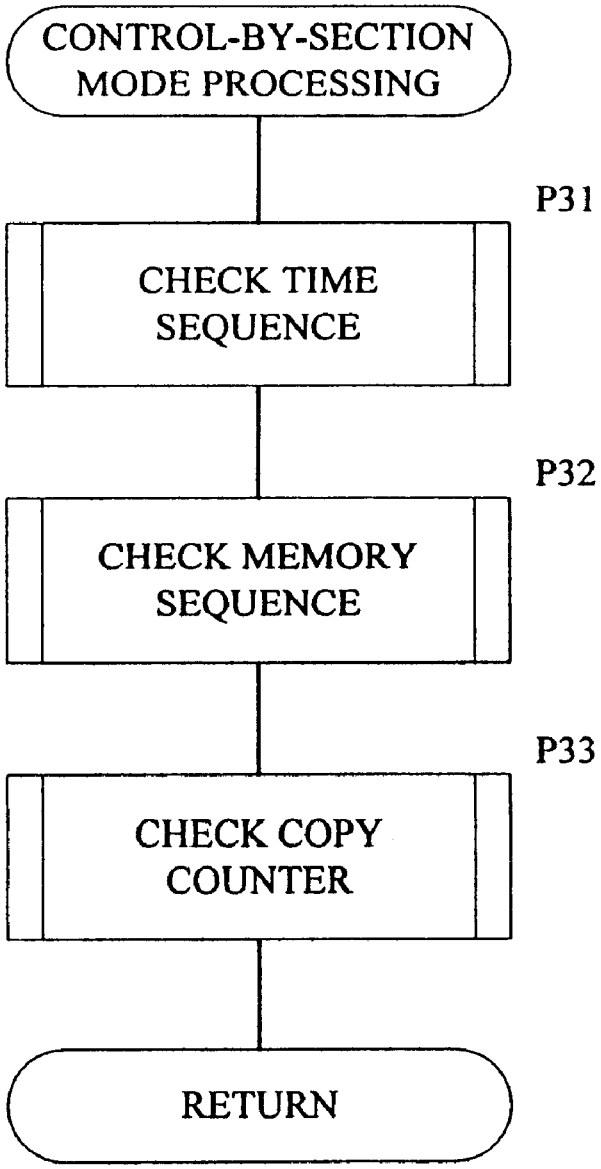
FIG. 8 is a flow chart showing in detail the control sequence for the control-by-section mode.

FIG. 8 is a flow chart showing the details of the control sequence for control-by-section mode shown as step P21 in the flow chart of FIG. 7. First, the current time is checked, and if a prescribed period set beforehand has elapsed since the time when 'automatic code input', i.e. the second mode, was set, said mode is canceled and automatic switching to normal registration mode, i.e., the first mode, is performed (step P31).

The amount of remaining memory in the access code registration memory is checked, and if the remaining memory amount is at or below a prescribed level, automatic code input mode, i.e., the second mode, is canceled, and normal registration mode, i.e., the first mode, is set. (step P32).

The value in the copy counter that counts the total number of copies is then checked, and if the count value is over a prescribed level, automatic code input mode (the second mode) is also canceled, and normal registration mode (the first mode) is set (step P33), whereupon CPU 601 returns to the main routine.

In other words, by limiting the effective period during which automatic code input mode or the second mode is present, the memory space in the access code registration memory in which access codes are registered is effectively used, enabling the registration of access codes for sections that make a large number of copies. In the routines in steps P31 through P33 described above, if a prescribed time interval has elapsed, the amount of remaining memory in the access code registration memory is at or below a prescribed level or the count value in the copy counter is over a prescribed level, in order to obtain more memory, it is acceptable to sequentially delete access codes that are not frequently used from the access code registration memory rather than change the mode to the first mode.

Figure 9:
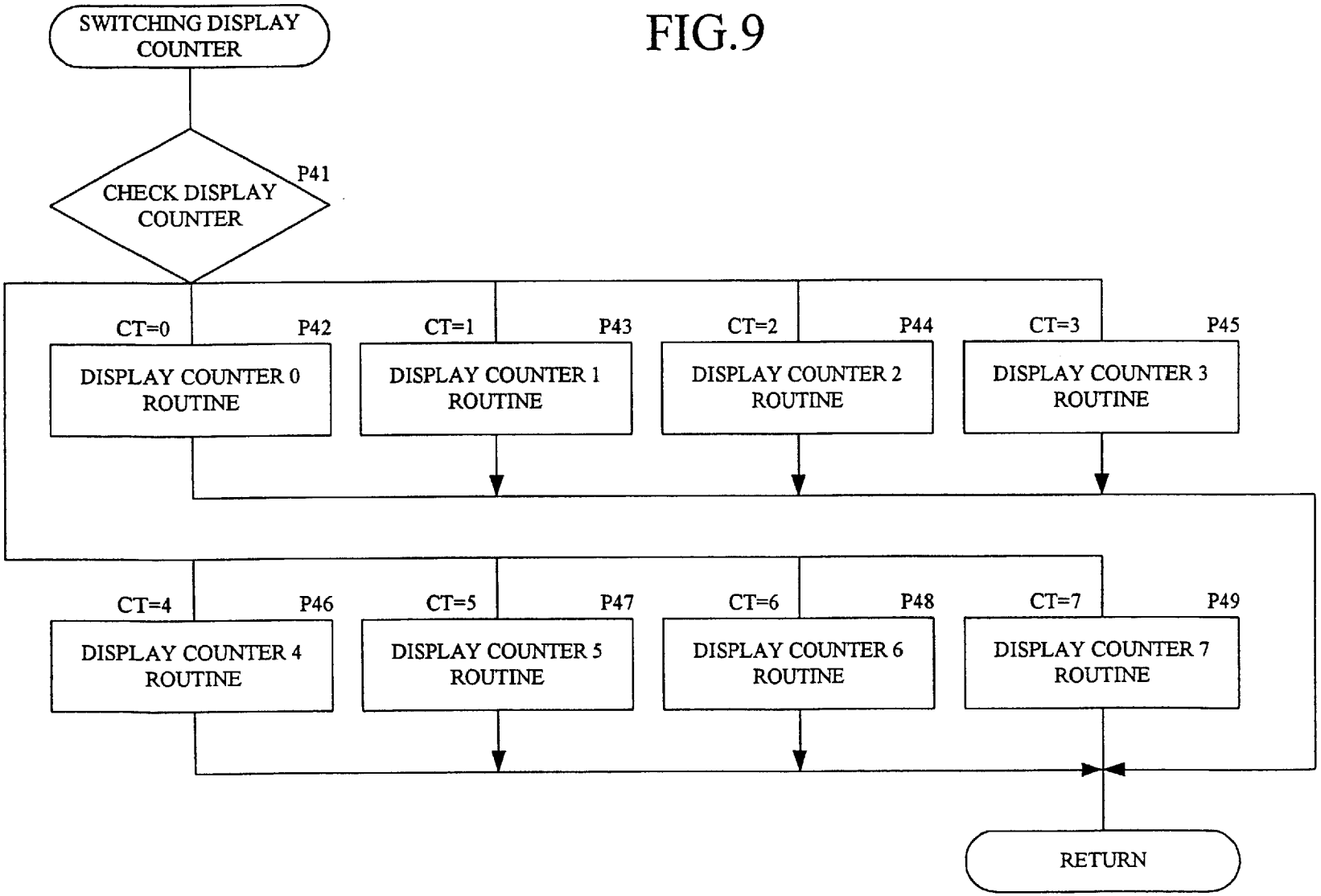
FIG. 9 is a flow chart showing in detail the switching sequence regarding the display counter.

FIG. 9 is a flow chart showing the details of the display counter switching routine shown as step P24 in the flow chart of FIG. 7. First, the value in the display counter is checked (step P41). Depending on the value in the display counter, one of the display counter 0 through 7 routines (steps P42 through P49) is executed, whereupon CPU 601 returns to the main routine. The details of said switching are explained below.

In the display counter 0 routine, if 'No' regarding control by section is selected and confirmed, the display counter is set to 0, and if 'Yes' regarding control by section is selected and confirmed, the display counter is set to 1.

Figure 10:
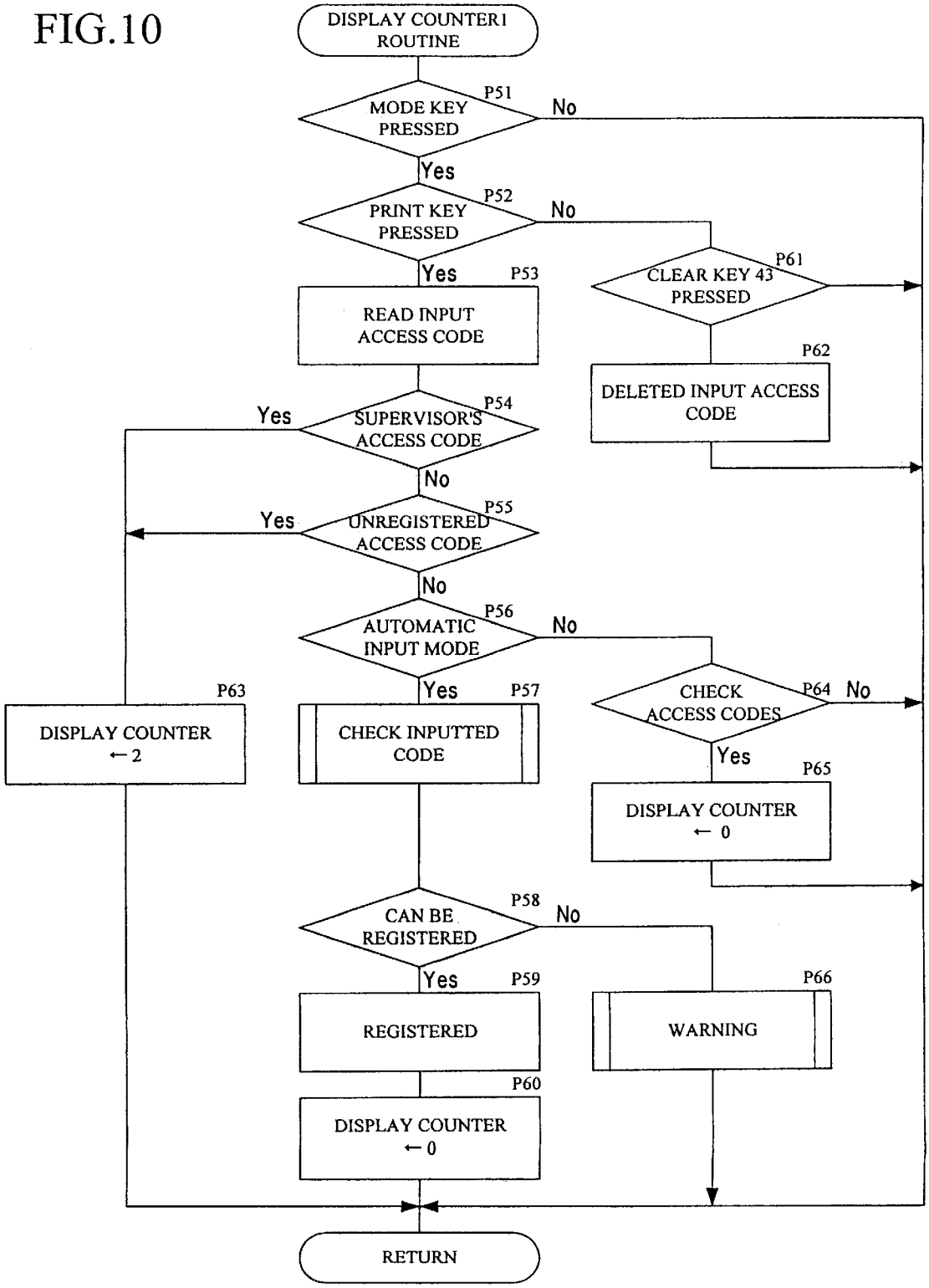
FIG. 10 is a flow chart showing in detail the display counter 1 routine.

FIG. 10 is a flow chart showing the details of the display counter 1 routine shown as step P43 in the flow chart of FIG. 9. First, a rising edge regarding control-by-section mode selection key 45 is sought (step P51). If no rising edge is detected, CPU 601 returns to the main routine. If a rising edge is detected, it is determined whether print key 41 has been pressed to confirm the access code input using 10-key keypad 42 (step P52).

If it is determined that print key 41 has been pressed, the input access code is read and it is determined whether or not it is the supervisor's access code (steps P53 and P54). If it is the supervisor's access code, the display counter is set to 2 (step P63) to permit setting of control-by-section functions, whereupon CPU 601 returns to the main routine. If it is determined in step P54 that the access code is not the supervisor's access code, it is determined whether or not the supervisor's access code is unregistered (step P55). If it is unregistered, the display counter is set to 2 (step P63) to permit setting of control-by-section functions, whereupon CPU 601 returns to the main routine.

Where the access code input is determined in steps P53 or P54 not to be the supervisor's access code or an unregistered code, it is determined whether or not automatic code input mode (the second mode) is selected (step P56). Where automatic code input mode (the second mode) is selected, it is verified whether the input access code is any of the access codes that have already been registered or any of the registered ineligible codes, to determine whether or not it can be registered (steps P57 and P58). If the input access code can be registered, it is registered (step P59), and the display counter is set to 0 to set the second mode (step P60), whereupon CPU 601 returns to the main routine.

If the access code is a previously registered code, said fact as well as a warning requesting the user to change the access code ('display 5' of FIG. 3(*e*)) is displayed. If the access code is a code that cannot be registered (an ineligible code), said fact is displayed together with a warning requesting the user to change the access code ('display 6' of (f) of FIG. 3) (step P66), whereupon CPU 601 returns to the main routine.

Where it is determined in step P56 that the current mode is not automatic code input mode (the second mode), the input access code is checked against the previously registered access codes (step P64). If the input access code matches any of the registered access codes, it is determined that copying operation may be permitted, and the display counter is set to 0 to set the first mode (step P65), whereupon CPU 601 returns to the main routine. If the input access code does not match any of the registered access codes, CPU 601 immediately returns to the main routine.

Where it is determined in step P52 that print key 41 has not been pressed, it is determined whether or not clear key 43 has been pressed (step P61). If it has been pressed, the input access code is deleted (step P62), and CPU 601 returns to the main routine. If clear key 43 has not been pressed, CPU 601 immediately returns to the main routine.

Figure 11:
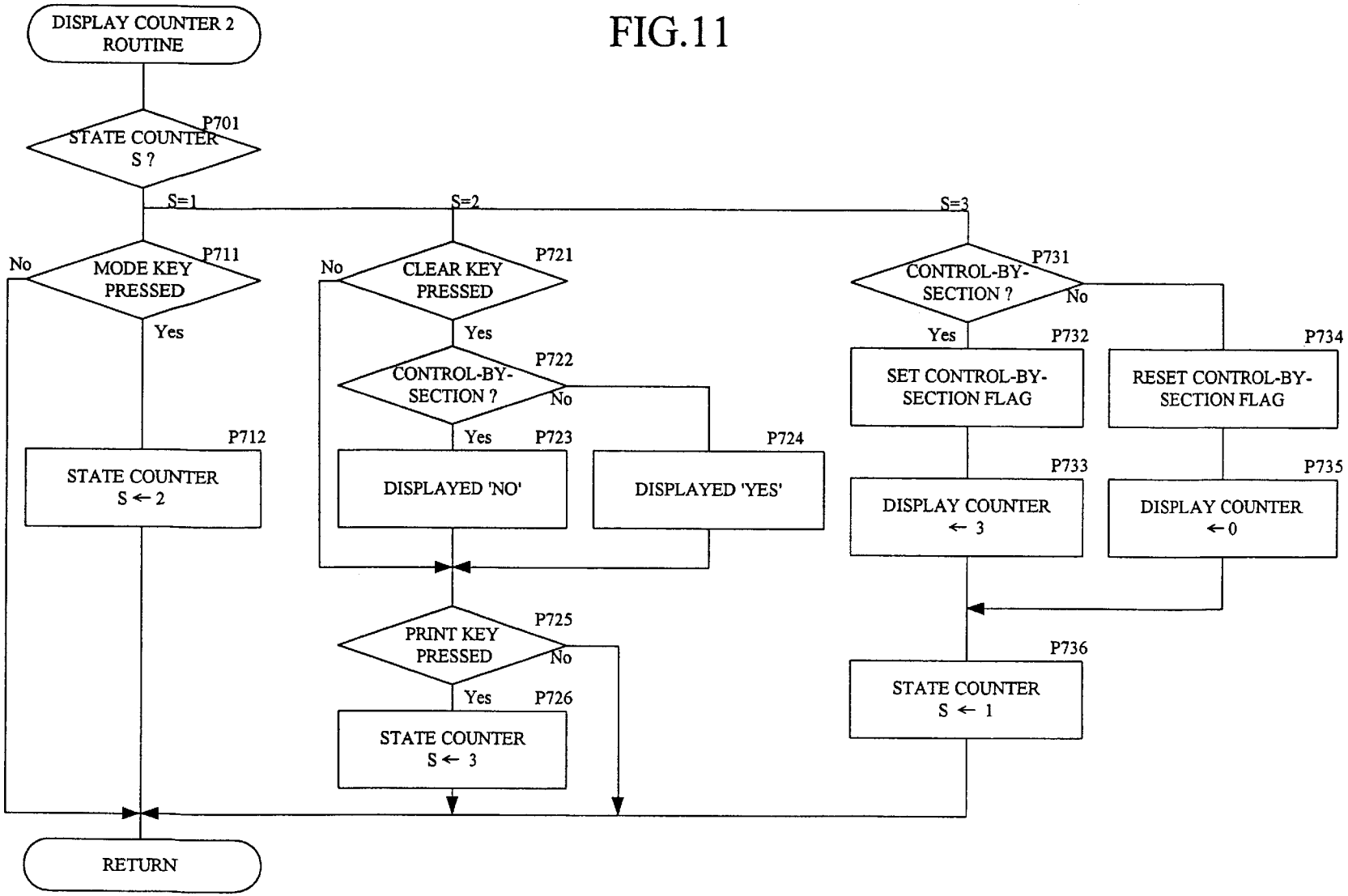
FIG. 11 is a flow chart showing in detail the display counter 2 routine.

FIG. 11 is a flow chart showing the details of the display counter 2 routine shown as step P44 in the flow chart of FIG. 9. First, the value in state counter S is checked. If said value is 1, CPU 601 proceeds to step P711. If it is 2, CPU 601 proceeds to step P721. If it is 3, CPU 601 proceeds to step P731 (step P701). Since state counter S is set to 1 in the initial condition, CPU 601 proceeds to step P711, and until a rising edge regarding control-by-section mode selection key 45 is detected, CPU 601 immediately returns to the main routine without changing the value in state counter S. When a rising edge is detected, the value in state counter S is changed to 2 (step P712).

Where the value in state counter S is set to 2, CPU 601 proceeds to step P721 to permit selection of 'Yes' or 'No' regarding control by section via the operation of clear key 43. In other words, if a rising edge regarding clear key 43 is sought and it is detected in step P721, the display for 'Yes'/'No' regarding control by section is checked (step P722). Where 'Yes' is displayed, the display is switched to 'No' regarding control by section (step P723), and where 'No' is displayed, the display is changed to 'Yes' regarding control by section (step P724). On the other hand, where a rising edge regarding clear key 43 is not detected in step P721, CPU 601 proceeds to step P725 to wait for the confirmation of the selection via the pressing of print key 41. If a rising edge regarding print key 41 is detected in step P725, the value in state counter S is set to 3. If a rising edge regarding print key 41 is not detected, CPU 601 immediately returns to the main routine.

Where the value in state counter S is set to 3, CPU 601 proceeds to step P731. When print key 41 is pressed while 'Yes' regarding control by section is being displayed, it is determined that 'Yes' regarding control by section is confirmed, whereupon CPU 601 proceeds to step P732 (step P731). In this case, the control-by-section flag is set (step P732), the value in the display counter is changed to 3 from 2 (step P733), and the value in state counter S is set to 1 (step P736), whereupon CPU 601 returns to the main routine. Where print key 41 is pressed when 'No' regarding control by section is being displayed, it is determined that 'No' regarding control by section is confirmed, whereupon CPU 601 proceeds to step P734 (step P731). In this case, the control-by-section flag is reset (step P734), the value in the display counter is change to 0 from 2 (step P735), and the value in state counter S is set to 1 (step P736) to have the regular screen display ('display 0' of FIG. 3 (*h*)), whereupon CPU 601 returns to the main routine.

Figure 12:
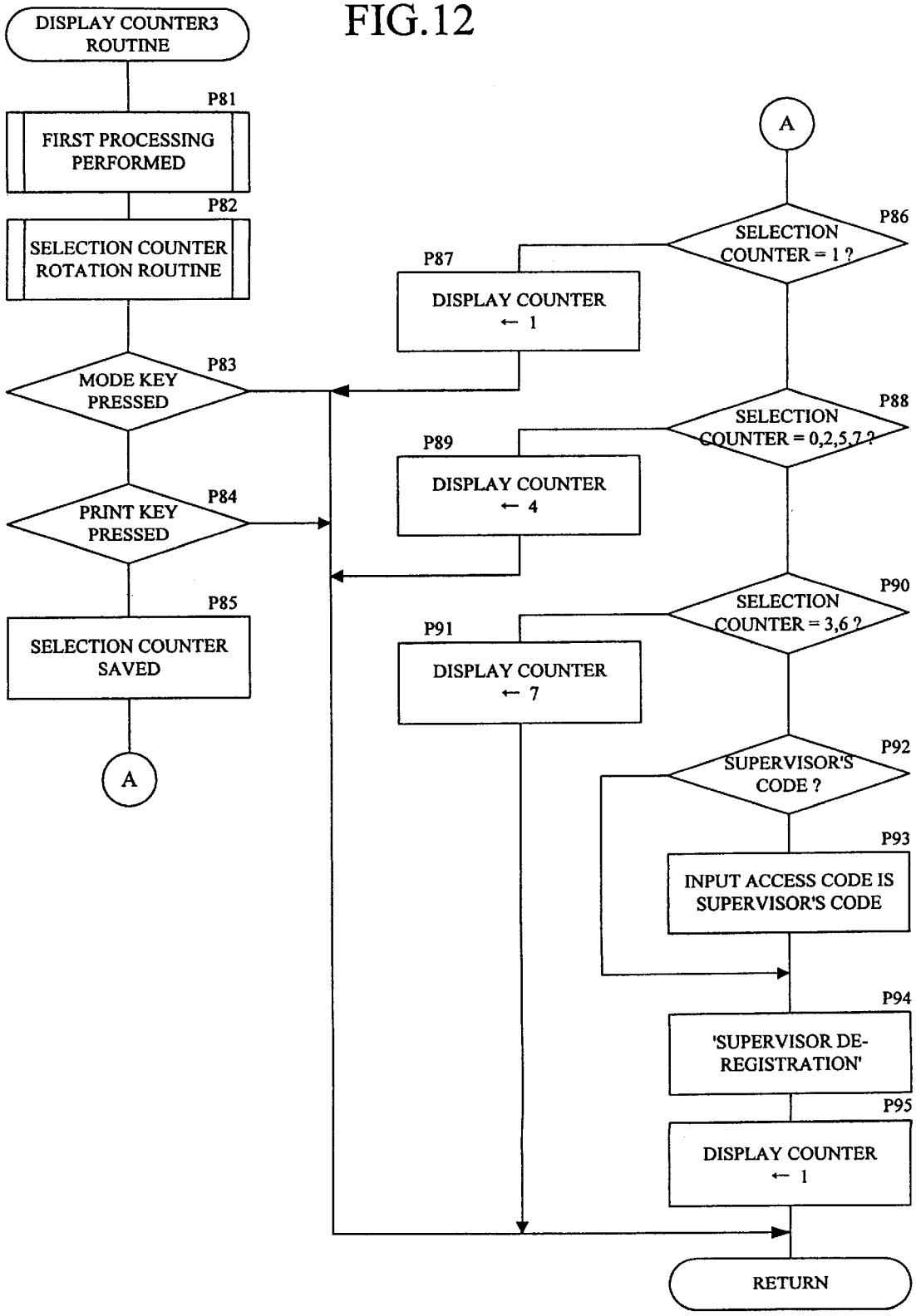
FIG. 12 is a flow chart showing in detail the display counter 3 routine.

FIG. 12 is a flow chart showing the details of the display counter 3 routine shown as step P45 in the flow chart of FIG. 9. First, first processing is performed (step P81). First processing is a process in which, when 'display 3' of FIG. 3(*c*) is being displayed on LCD unit 61, the characters that indicate the control-by-section mode currently residing in memory ('normal registration' or 'automatic code input') are displayed in a special manner (white-on-black display, for example). Through this processing, the mode currently in the memory can be confirmed on the 'display 3' screen of the LCD unit.

The selection counter rotation routine, in which the display of the selection counter is alternated in sequential fashion, is then executed in response to the operation of clear key 43 to select 'normal registration' 'automatic code input' 'supervisor registration' 'see counter', 'delete' or 'ineligible code registration' (step P82). It is then determined whether or not a rising edge regarding the control-by-section mode selection key is detected (step P83), and where a rising edge is detected, it is determined whether or not the mode selected was confirmed based on a rising edge regarding print key 41 (step P84). If a rising edge regarding print key 41 is detected, the current selection on the selection counter is saved (step P85). Where no rising edge is detected in steps P83 or P84, CPU 601 immediately returns to the main routine.

The value in the selection counter is then checked (step P86), and if the value is 1, the display counter is set to 1 (step P87), whereupon CPU 601 returns to the main routine. Automatic code input mode is begun in this event.

Where the value in the selection counter is 0, 2, 5 or 7, the display counter is set to 4 (steps P88 and P89), and CPU 601 returns to the main routine. Input of an access code is requested in this case. The input access code is processed in accordance with the value in the selection counter (0, 2, 5 or 7). In other words, if the value in the selection counter is 0, 'normal registration' is implemented. If it is 2, 'supervisor registration' in normal registration mode is implemented. If it is 5, 'supervisor registration' in automatic code input mode is implemented, and if it is 7, 'ineligible code registration' is implemented.

Where the value in the selection counter is 3 or 6, the display counter is set to 7 (steps P90 and P91), and CPU 601 returns to the main routine. In this case, the value in the copy counter for the section designated by the access code is displayed.

Where a negative determination is obtained in steps S86, 88 and 90, the value in the selection counter should be 4. In this case, a registered access code is deleted. In other words, it is determined whether or not the input access code is the supervisor's code (step P92). If it is the supervisor's code, the 'supervisor de-registration' process takes place (step P93), the supervisor's registration is deleted (step P94), and the display counter is set to 1 (step P95), whereupon CPU 601 returns to the main routine. Where it is determined in step P92 that the code is not the supervisor's code, CPU 601 returns to the routines including and after step P94. It then deletes registration of that code and sets the display counter to 1, whereupon it returns to the main routine.

The value in the selection counter and the 'display 3' screen of (c) of FIG. 3 have the relationship shown in Table 2 below.

Table 2

Selection counter value is 0→ 'Normal registration'
Selection counter value is 1→ 'Automatic code input'
Selection counter value is 2→ 'Supervisor registration' (in normal registration mode)
Selection counter value is 3→ 'See counter' (in normal registration mode)
Selection counter value is 4→ 'Delete' (in normal registration mode)
Selection counter value is 5→ 'Supervisor registration' (in automatic code input mode)
Selection counter value is 6→ 'See counter' (in automatic code input mode)
Selection counter value is 7→ 'Ineligible code registration'

Although the details of the display counter 4 routine are not shown using a flow chart, in this routine, processing to display 'normal registration', 'supervisor registration' or 'ineligible code registration' takes place. First, it is determined whether or not a rising edge regarding the control-by-section mode selection key is detected, and if it is not detected, CPU 601 immediately returns to the main routine. If a rising edge is detected, processing takes place in response to the value in the selection counter. In other words, if the value in the selection counter is 0, 'normal registration' is displayed. If it is 2, 'supervisor registration' is displayed. If it is 7, 'ineligible code registration' is displayed. The value in the display counter is then changed to 1 from 4, whereupon CPU 601 returns to the main routine.

Although the details of the display counter 5, 6 or 7 routines are not shown using a flow chart, in the display counter 5 routine, since the input access code is a registered code, input of a different access code is requested. Confirmation and re-input of the input access code are displayed. In the display counter 6 routine, since the input access code is a code that cannot be registered, inputting of a different access code is requested. Confirmation and reinput of the input access code are then displayed. In the display counter 7 routine, the value in the copy counter for the section that corresponds to the input access code is displayed and the value in the display counter is changed to 1 from 7, whereupon CPU 601 returns to the main routine.

As explained above, the present invention comprises a copying machine that can control its use using access codes, and since it has a second mode comprising automatic code input mode that permits copying through the inputting of an access code at the time that the user uses the copying machine and that registers said access code, in addition to a first mode that comprises a regular mode permitting copying when an access code that matches any of previously registered access codes is input, sections that have actually used the copying machine can be registered in a speedy fashion and the need for copying can be met in a timely fashion as well. In addition, the inconvenience of having access codes registered by a specific supervisor or service technician can be omitted, so that registration of sections that do not actually use the copying machine can be avoided and only sections that do use the copying machine can be registered.

Further, by limiting the period for which the access codes registered in automatic code input mode are valid, the memory capacity in the access code registration memory can be effectively utilized and only sections that actually use the copying machine can be registered.

Moreover, since double registration of previously registered access codes can be avoided and access codes that are not to be registered can also be set, the memory capacity can be effectively utilized even if the memory capacity of the access code registration memory is small.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an input unit which inputs codes;

a code memory which stores registration codes;

a code comparison unit which compares said inputted codes with said registration codes which are stored in said code memory; and a control unit which permits or inhibits an image forming operation in accordance with a result of the comparison of said comparison unit when the image forming apparatus is in a first mode, and which stores an inputted code in said code memory as a registration code when the image forming apparatus is in a second mode, wherein when the image forming apparatus is in the second mode, the control unit switches the image forming apparatus from the second mode to the first mode after a prescribed period of time has elapsed.

2. An image forming apparatus comprising:

an input unit which inputs codes;

a code memory which stores registration codes;

a code comparison unit which compares said inputted codes with said registration codes which are stored in said code memory; and a control unit which permits or inhibits an image forming operation in accordance with a result of the comparison of said comparison unit when the image forming apparatus is in a first mode, and which stores an inputted code in said code memory as a registration code when the image forming apparatus is in a second mode, wherein said registration codes stored in said code memory has two groups one of which is for permitting the image forming operation and the another of which is for inhibiting the image forming operation.

3. The image forming apparatus of claim 2, wherein, when the image forming apparatus is in the second mode, said control unit stores the inputted code in the code memory as a registration code in a case that the inputted code has not been stored in the code memory, and refuses to store the inputted code in the code memory as a registered code in a case that the inputted code is identical with one of the registration codes which belongs to the group for inhibiting the image forming operation.

4. A control method for an image forming apparatus comprising the steps of:

an input step for inputting a code;

a determination step for determining whether the input code matches any one of a plurality of registration codes stored in a code memory; and a control step for permitting or inhibiting an image forming operation in accordance with the determination when the image forming apparatus is in a first mode, and for storing the inputted code in said code memory as a registration code when the image forming apparatus is in a second mode, wherein when the image forming apparatus is in the second mode, the image forming apparatus is switched from the second mode to the first mode after a prescribed period of time has elapsed.

5. A control method for an image forming apparatus comprising the steps of:

an input step for inputting a code;

a determination step for determining whether the input code matches any one of a plurality of registration codes stored in a code memory; and a control step for permitting or inhibiting an image forming operation in accordance with the determination when the image forming apparatus is in a first mode, and for storing the inputted code in said code memory as a registration code when the image forming apparatus is in a second mode, wherein said registration codes stored in said code memory has two groups one of which is for permitting the image forming operation and the another of which is for inhibiting the image forming operation.

6. The image forming method of claim 5, wherein, when the image forming apparatus is in the second mode, said control step stores the inputted code in the code memory as a registration code in a case that the inputted code has not been stored in the code memory, and refuses to store the inputted code in the code memory as a registration code in a case that the inputted code is identical with one of the registration codes which belongs to the group for inhibiting the image forming operation.

7. An image forming apparatus comprising:

an input unit which inputs codes;

a code memory that stores registration codes;

a code verification means that verifies whether an input code input by the input unit matches any of the registration codes stored in the code memory;

a mode designation means that designates either a first mode or a second mode;

a control means, wherein when a first mode is designated by said mode designation means, said control means permits an image forming operation when it is determined from the result of the verification performed by the code verification means that the input code is identical to a registration code for which operation of the image forming apparatus is permitted, and when a second mode is designated, said control means stores the input code in the code memory as a registration code; and a detecting means that detects the remaining memory capacity in the code memory, wherein when the detected remaining memory capacity falls below a certain level when the image forming apparatus is in the second mode, the image forming apparatus switches from the second mode to the first mode.

8. An image forming apparatus comprising:

an input unit which inputs codes;

a code memory that stores registration codes;

a code verification means that verifies whether an input code input by the input unit matches any of the registration codes stored in the code memory;

a mode designation means that designates either a first mode or a second mode; and a control means, wherein when a first mode is designated by said mode designation means, said control means permits an image forming operation when it is determined from the result of the verification performed by the code verification means that the input code is identical to a registration code for which operation of the image forming apparatus is permitted, and when a second mode is designated, said control means stores the input code in the code memory as a registration code; and a copy number detecting means that detects the number of copies made, wherein when the detected number of copies is higher than a prescribed level when the image forming apparatus is in the second mode, the image forming apparatus switches from the second mode to the first mode.

9. An image forming apparatus comprising:

an input unit which inputs codes;

a code memory that stores registration codes;

a code verification means that verifies whether an input code input by the input unit matches any of the registration codes stored in the code memory;

a mode designation means that designates either a first mode or a second mode; and a control means, wherein when a first mode is designated by said mode designation means, said control means permits an image forming operation when it is determined from the result of the verification performed by the code verification means that the input code is identical to a registration code for which operation of the image forming apparatus is permitted, and when a second mode is designated, said control means stores the input code in the code memory as a registration code; and a time detecting means that detects a predetermined amount of time elapsed, wherein when the it is detected by said time detecting means that the predetermined time is elapsed when the image forming apparatus is in the second mode, the image forming apparatus switches from the second mode to the first mode.

10. An image forming apparatus comprising:

an input unit which inputs codes;

a code memory that stores registration codes;

a code verification means that verifies whether an input code input by the input unit matches any of the registration codes stored in the code memory;

a mode designation means that designates either a first mode or a second mode; and a control means, wherein when a first mode is designated by said mode designation means, said control means permits an image forming operation when it is determined from the result of the verification performed by the code verification means that the input code is identical to a registration code for which operation of the image forming apparatus is permitted, and when a second mode is designated, said control means stores the input code in the code memory as a registration code, wherein said registration codes stored in said code memory has two groups one of which is for permitting the image forming operation and the another of which is for inhibiting the image forming operation.

11. An image forming apparatus comprising:

a storage device for storing a plurality of codes as registration codes;

an input unit for inputting a code;

a mode setter for setting one of a first mode and a second mode, the second mode being different from the first mode;

an image forming unit for performing an image formation; and a controller for permitting the image formation when a code input by the input unit is the same as any of the plurality of codes stored in the storage device when the first mode is set by the mode setter, and for permitting the image formation when a code input by the input unit is different from all of the plurality of codes stored in the storage device when the second mode is set by the mode setter.

12. The image forming apparatus of claim 11, wherein, when the second mode is set by the mode setter, said controller stores the code input by the input unit in the storage device as a registration code.

13. The image forming apparatus of claim 11, wherein, when the code input by the input unit is the same as any of the plurality of codes stored in the storage device when the second mode is set by the mode setter, said controller displays a message indicating that the input code is the same as a stored code.

14. The image forming apparatus of claims 11, wherein, when a predetermined condition is satisfied when the second mode is set by the mode setter, said controller cancels the second mode and sets the first mode.

15. The image forming apparatus of claims 14, wherein said predetermined condition is that a predetermined time period has elapsed since the time when the second mode was set.

16. The image forming apparatus of claim 14, wherein said predetermined condition is that the remaining storage capacity of the storage device is equal to or less than a predetermined value.

17. The image forming apparatus of claim 14, wherein said predetermined condition is that the total number of the image formation operations is greater than a predetermined value.

* * * * *